US011835046B2

(12) United States Patent
Zhang et al.

(10) Patent No.: US 11,835,046 B2
(45) Date of Patent: Dec. 5, 2023

(54) MAIN BEARING HOUSING ASSEMBLY AND SCROLL COMPRESSOR HAVING THE MAIN BEARING HOUSING ASSEMBLY

(71) Applicant: Emerson Climate Technologies (Suzhou) Co., Ltd., Jiangsu (CN)

(72) Inventors: Yue Zhang, Jiangsu (CN); Yuan Qian, Jiangsu (CN)

(73) Assignee: Copeland Climate Technologies (Suzhou) Co., Ltd., Jiangsu (CN)

( * ) Notice: Subject to any disclaimer, the term of this patent is extended or adjusted under 35 U.S.C. 154(b) by 29 days.

(21) Appl. No.: 17/772,904

(22) PCT Filed: Aug. 13, 2020

(86) PCT No.: PCT/CN2020/108769

§ 371 (c)(1),
(2) Date: Apr. 28, 2022

(87) PCT Pub. No.: WO2021/082627

PCT Pub. Date: May 6, 2021

(65) Prior Publication Data

US 2022/0364562 A1 Nov. 17, 2022

(30) Foreign Application Priority Data

Oct. 31, 2019 (CN) ..... 201911052915.6
Oct. 31, 2019 (CN) ..... 201921862906.9

(51) Int. Cl.
*F04C 29/02* (2006.01)
*F04C 18/02* (2006.01)
*F04C 29/00* (2006.01)

(52) U.S. Cl.
CPC ..... *F04C 29/02* (2013.01); *F04C 18/0215* (2013.01); *F04C 29/00* (2013.01); *F04C 2240/801* (2013.01)

(58) Field of Classification Search
CPC ..... F04C 18/0207–0292; F04C 29/00; F04C 29/02; F04C 29/021; F04C 29/023;
(Continued)

(56) References Cited

U.S. PATENT DOCUMENTS 4,874,302 A * 10/1989 Kobayashi ..... F04C 18/0215 418/55.6
5,370,513 A * 12/1994 Fain ..... F04C 18/0215 418/94

(Continued)

FOREIGN PATENT DOCUMENTS

CN 209340147 U 9/2019
CN 211144809 U 7/2020

(Continued)

OTHER PUBLICATIONS

International Search Report (in English and Chinese) and Written Opinion of the International Searching Authority (Chinese) issued in PCT/CN2020/108769, dated Nov. 4, 2020; ISA/CN.

*Primary Examiner* — Mark A Laurenzi
*Assistant Examiner* — Xiaoting Hu
(74) *Attorney, Agent, or Firm* — Harness, Dickey & Pierce, P.L.C.

(57) ABSTRACT

A main bearing housing assembly for a scroll compressor and a scroll compressor having the main bearing housing assembly. The main bearing housing assembly comprises: a main bearing housing; and a thrust plates, the thrust plate being provided at the top of the main bearing housing, and comprising a thrust surface located at the top and in surface contact with the bottom end surface of a scroll assembly of the scroll compressor; the thrust plate comprises: at least one oil inlet hole; a closed oil chamber, the closed oil chamber being formed in the thrust plate; and at least one oil outlet hole, the opening of the at least one oil outlet hole being exposed to the thrust surface; and the at least one oil inlet (Continued)

hole is in communication with the at least one oil outlet hole by means of the closed oil chamber.

12 Claims, 6 Drawing Sheets

(58) Field of Classification Search
CPC ..... F04C 29/025; F04C 29/028; F04C 2240/801; F04C 2240/809; F04C 2240/30
See application file for complete search history.

(56) References Cited

U.S. PATENT DOCUMENTS 5,372,490 A * 12/1994 Fain ..... F04C 29/028 184/6.24
2013/0323105 A1* 12/2013 Chao ..... F04C 23/008 418/55.6

FOREIGN PATENT DOCUMENTS

JP S63134883 A 6/1988
JP 2007-170291 A 7/2007

* cited by examiner

MAIN BEARING HOUSING ASSEMBLY AND SCROLL COMPRESSOR HAVING THE MAIN BEARING HOUSING ASSEMBLY

This disclosure is the national phase of International Application No. PCT/CN2020/108769 titled "MAIN BEARING HOUSING ASSEMBLY AND SCROLL COMPRESSOR HAVING THE MAIN BEARING HOUSING ASSEMBLY" and filed on August 13, 2020, which claims priorities to the following two Chinese patent applications, both of which are incorporated herein by reference:

1) Chinese Patent Application No. 201911052915.6, titled "MAIN BEARING HOUSING ASSEMBLY AND SCROLL COMPRESSOR HAVING THE MAIN BEARING HOUSING ASSEMBLY", filed with the China National Intellectual Property Administration on Oct. 31, 2019; and 2) Chinese Patent Application No. 201921862906.9, titled "MAIN BEARING HOUSING ASSEMBLY AND SCROLL COMPRESSOR HAVING THE MAIN BEARING HOUSING ASSEMBLY", filed with the China National Intellectual Property Administration on Oct. 31, 2019.

TECHNICAL FIELD

The present disclosure relates to a main bearing housing assembly for a scroll compressor, specifically relates to a main bearing assembly with a shower-type oil distribution path. In addition, the present disclosure further relates to a scroll compressor including the main bearing housing assembly.

BACKGROUND

This section provides background information relating to the present disclosure, which may not necessarily constitute the prior art.

A scroll compressor can be used in a refrigeration system, an air conditioning system and a heat pump system. The scroll compressor generally includes: a compression mechanism for compressing a working fluid (such as a refrigerant), the compression mechanism including an orbiting scroll and a non-orbiting scroll; a thrust plate located on a side of an end plate of the orbiting scroll, and a thrust surface of the thrust plate is in surface contact with an end surface of the end plate of the orbiting scroll to support the orbiting scroll, so that the orbiting scroll is in stable engagement with the non-orbiting scroll; and a lubricating oil source that stores lubricating oil supplied to various moving parts for lubrication. When the scroll compressor is in operation, the orbiting scroll performs orbital relative motion relative to the non-orbiting scroll, and the non-orbiting scroll also performs orbital relative motion relative to the thrust plate. Therefore, there is a relative frictional motion between the end surface of the end plate of the orbiting scroll and the thrust surface of the thrust plate, which may produce wear and a large amount of friction heat between the end plate of the orbiting scroll and the thrust plate, and thus increase the power consumption. In order to reduce wear and reduce power consumption, it is necessary to provide lubrication (such as lubricating oil) between the end surface of the end plate of the orbiting scroll and the thrust surface of the thrust plate to reduce friction.

However, in practical disclosure, it is found that, the scroll compressor according to the conventional technology, especially under a high load condition, generally has the problem of severe wear between the orbiting scroll and the thrust plate, which leads to the blackening of the lubricating oil.

Therefore, there is a need to improve the lubrication between the end surface of the orbiting scroll and the thrust surface of the thrust plate.

SUMMARY

A general summary of the present disclosure is provided in this section, rather than the full scope of the present disclosure or a comprehensive disclosure of all features of the present disclosure.

An object according to the present disclosure is to provide a thrust plate capable of promoting lubrication between a thrust surface and an end surface of an orbiting scroll.

Another object according to the present disclosure is to provide a scroll compressor capable of reducing friction between the thrust surface and the end surface of the orbiting scroll.

According to one aspect of the present disclosure, a main bearing housing assembly for a scroll compressor is provided, which includes: a main bearing housing, and a thrust plate provided on a top of the main bearing housing and including a thrust surface at a top of the thrust plate and in surface contact with a bottom end surface of a scroll assembly of the scroll compressor. The thrust plate includes: at least one oil inlet hole; a closed oil chamber, formed in the thrust plate; and at least one oil outlet hole with an orifice exposed on the thrust surface. The at least one oil inlet hole is in communication with the at least one oil outlet hole through the closed oil chamber.

Optionally, the closed oil chamber is a single annular oil chamber formed along a circumferential direction of the thrust plate; or the closed oil chamber is multiple discrete oil chambers arranged along a circumferential direction of the thrust plate.

Preferably, the oil outlet hole is embodied as a plurality of oil outlet holes, and a groove, which makes the orifices of the plurality of oil outlet holes to be communicated, is formed on the thrust surface.

Preferably, the main bearing housing assembly further comprises a pressure relief valve arranged at the thrust plate for regulating a pressure in the closed oil chamber.

Preferably, the oil inlet hole is embodied as a plurality of oil inlet holes which are arranged equally spaced apart around a central axis of the thrust plate.

Preferably, the number of the oil outlet hole is greater than the number of the oil inlet hole, and the oil outlet holes are arranged equally spaced apart around a central axis of the thrust plate.

Optionally, the thrust plate is integrally formed on the main bearing housing, or the thrust plate is an independent member arranged at the top of the main bearing housing, wherein the thrust plate has an oil groove configured to be closed from a bottom of the oil groove to form the closed oil chamber.

Optionally, the oil groove of the thrust plate is sealed by a top surface of the main bearing housing to form the closed oil chamber in a case that the thrust plate is the independent member; or in a case that the thrust plate is the independent member, the main bearing housing assembly further includes a cover plate configured to be in close fit with a bottom of the thrust plate, and when the thrust plate and the cover plate are in an assembled state, the oil groove of the thrust plate is closed by the cover plate to form the closed oil chamber.

According to another aspect of the present disclosure, a scroll compressor is provided, and the scroll compressor includes a scroll assembly which includes a non-orbiting scroll member and an orbiting scroll member for compressing a working fluid, and the main bearing housing assembly according to the previous aspect of the present disclosure.

Preferably, the scroll compressor further includes a pumping mechanism, the pumping mechanism is configured to provide lubricant to a moving part, including the scroll assembly, of the scroll compressor, and the oil inlet hole of the thrust plate is in communication with the pumping mechanism, so that the lubricant is directly and actively provided to the thrust plate by the pumping mechanism.

Preferably, the pumping mechanism is a positive displacement pump.

By using the main bearing housing assembly according to the embodiments of the present disclosure and the scroll compressor including the main bearing housing assembly, the lubrication between the thrust surface and the end surface of the orbiting scroll member can be improved compared with the conventional technology by additionally supplying oil to the thrust surface through the thrust plate. In particular, the shower-type distribution path of the thrust plate can directly and actively provides the lubricant to the thrust surface by the pumping mechanism, which can provide additional lubrication and cooling to the thrust surface more uniformly and more efficiently. In addition, the thrust plate and the scroll compressor according to the present disclosure have a simple structure, easy processing and manufacture and high cost-effectiveness.

BRIEF DESCRIPTION OF THE DRAWINGS

The foregoing and additional features and characteristics of the present disclosure will become more apparent from the following detailed description with reference to the accompanying drawings, which are merely examples and are not necessarily drawn to scale. Same reference numerals in the drawings indicate same parts. In the drawings.

DETAILED DESCRIPTION OF THE EMBODIMENTS

The preferred embodiments of the present disclosure will now be described in detail with reference to the drawings. The following description is merely exemplary in nature and is not intended to limit the present disclosure and the application or use thereof.

In the following exemplary embodiments, the scroll compressor is exemplarily shown as a vertical scroll compressor. However, the scroll compressor according to the present disclosure is not limited to this type, but may be any type of scroll compressor, such as a horizontal scroll compressor.

Figure 1:
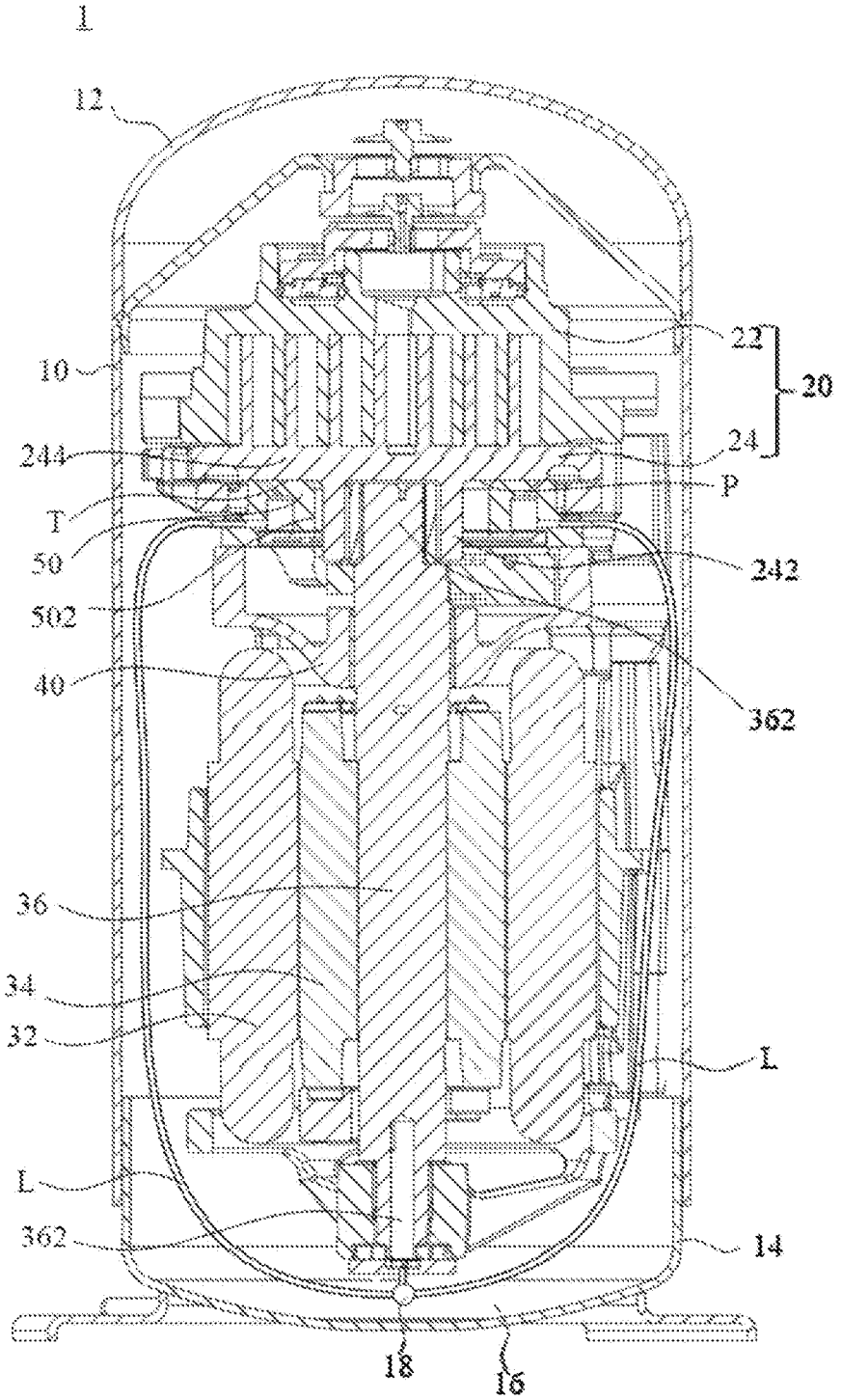
FIG. 1 is a longitudinal cross-sectional view of a scroll compressor according to the present disclosure.

FIG. 1 is a longitudinal cross-sectional view of the scroll compressor according to the present disclosure. Firstly, an overall structure of the scroll compressor is briefly described with reference to FIG. 1.

As shown in FIG. 1, the scroll compressor 1 may include a substantially cylindrical housing 10, an electric motor, a drive shaft 36, a main bearing housing 40, a non-orbiting scroll (or referred to as a non-orbiting scroll member) 22 and an orbiting scroll (or referred to as an orbiting scroll member) 24. The orbiting scroll 24 and the non-orbiting scroll 22 together constitute a compression mechanism 20 for compressing a working fluid (such as a refrigerant), in which the non-orbiting scroll 22 includes a non-orbiting scroll end plate, a non-orbiting scroll wrap and an exhaust port located at a center of the non-orbiting scroll 22; the orbiting scroll 24 includes an orbiting scroll end plate 244, an orbiting scroll wrap extending from a surface of the orbiting scroll end plate 244 facing a surface of the non-orbiting scroll 22, and a hub 242 extending from a surface (hereinafter, simply referred to as an end surface) P of a side, opposite to the orbiting scroll wrap, of the orbiting scroll end plate 244. An open suction chamber in fluid communication with an intake port of the compression mechanism 20 and a closed compression chamber for compressing the working fluid formed by the engagement of the non-orbiting scroll wrap and the orbiting scroll wrap, are defined in the compression mechanism 20.

A top cover 12 may be mounted at a top of the housing 10, and a seat 14 may be mounted at a bottom of the housing 10, so as to define an internal volume of the scroll compressor 1. For example, lubricant, such as lubricating oil, may be stored in a bottom oil sump 16 to lubricate various moving parts of the scroll compressor 1, such as the orbiting scroll 24, the non-orbiting scroll 22 and the thrust plate 50. Herein, the oil sump 16 is used as a lubricant source.

The electric motor includes a stator 32 and a rotor 34. The rotor 34 is used to drive the drive shaft 36, so as to rotate the drive shaft 36 about its rotation axis relative to the housing. The drive shaft 36 may include an eccentric pin 362, which is mounted to a first end (a top end) of the drive shaft 36 or is integrally formed with the first end of the drive shaft 36. The drive shaft 36 further includes a central hole 364 and an eccentric hole (not shown), the central hole 364 is formed at a second end (a bottom end) of the drive shaft 36, and the eccentric hole extends upward from the central hole 364 to an end surface of the eccentric pin 362. An end (a lower end) of the central hole 364 can be immersed in the oil sump 16 at the bottom of the scroll compressor 1, so that for example, under the centrifugal force generated by the rotation of the drive shaft 36, the lubricating oil can be transported from the oil sump 16 at the bottom, and the lubricating oil can flow upward through the central hole 364 and the eccentric hole and flow out from the end surface of the eccentric pin 362.

The lubricating oil flowing out from the end surface of the eccentric pin 362 can flow to lubricating oil supply zones, for example, formed between the eccentric pin 362 and the orbiting scroll 24 and between the main bearing housing 40 and the orbiting scroll 24. The lubricating oil in the lubricating oil supply zones can lubricate rotating joints and sliding surfaces, for example, between the eccentric pin 362 and the orbiting scroll 24 and between the main bearing housing 40 and the orbiting scroll 24. Moreover, as will be further described below, lubricating oil in the lubricating oil supply zones may also be supplied to the compression mechanism 20.

The orbiting scroll 24 is axially supported by the main bearing housing 40 and is capable of orbiting supported by the main bearing housing 40. The hub 242 of the orbiting scroll 24 may be rotatably coupled to the eccentric pin 362. Alternatively, the hub 242 may be rotatably coupled to the eccentric pin 362 via a sleeve or a bearing. As described above, the lubricating oil supplied to the eccentric pin 362 and flowing out from the eccentric pin 362 through the above exemplary eccentric oil supply scheme can then enter a space inside the hub 242. The lubricating oil accumulates in a recess of the main bearing housing 40 after lubricating the hub 242, the eccentric pin 362 or the bearing. The lubricating oil in the recess of the main bearing housing 40 adheres to a thrust surface above the orbiting scroll end plate 244 and the main bearing housing 40 in the form of oil mist under the rotational agitation such as the hub 242 or a balance block (not shown) of the orbiting scroll 24, so as to realize the lubrication between the orbiting scroll end plate 244 and the thrust surface T that provides axial support for the orbiting scroll 24.

Figure 2:
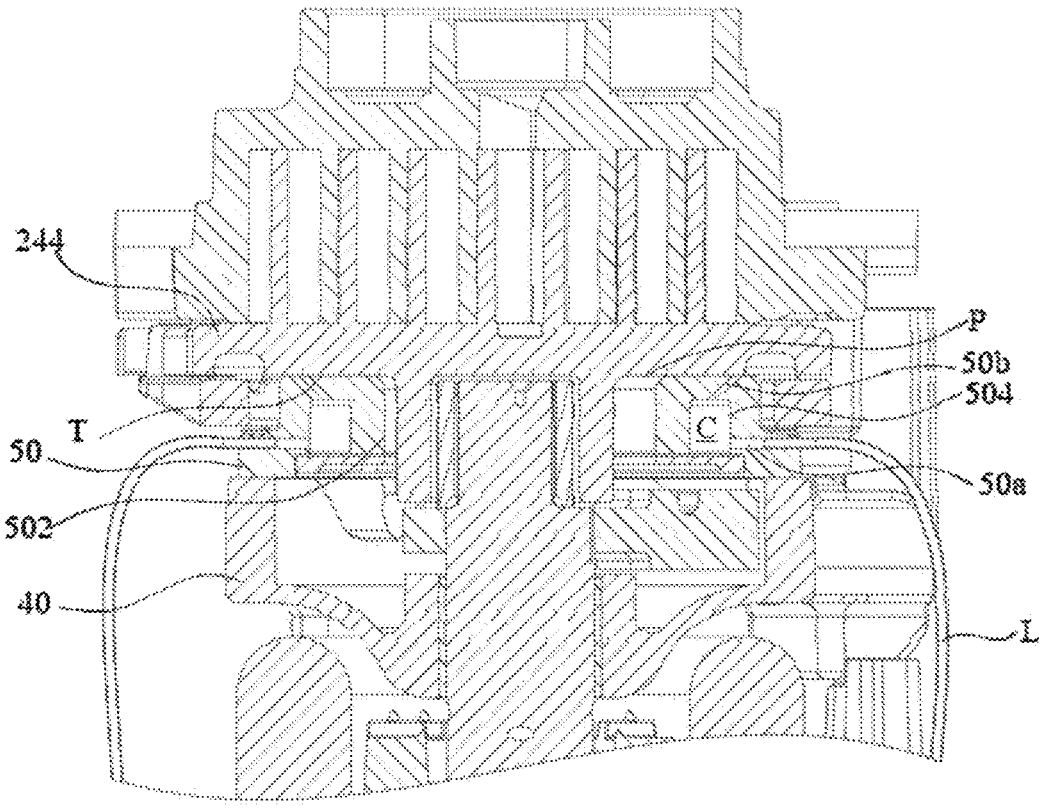
FIG. 2 is an enlarged partial longitudinal cross-sectional view of the scroll compressor including a compression mechanism, a thrust plate and a main bearing housing, which shows a structure of the thrust plate according to a first embodiment of the present disclosure.

Particularly, in the embodiment of the present disclosure, as shown in FIG. 1, the thrust surface T is provided by a separately provided thrust plate 50 arranged between the orbiting scroll end plate 244 and the main bearing housing 40. FIG. 2 is an enlarged partial longitudinal cross-sectional view of the scroll compressor according to the present disclosure, which clearly shows the thrust plate 50, the orbiting scroll 24 and the main bearing housing 40 according to an aspect of the present disclosure. In addition, components such as the housing and the motor are omitted for ease of description. Generally, the thrust plate 50 is a disk-shaped member and has a central through hole 502 at the center for the hub 242 of the orbiting scroll 24 to pass through, and an upper surface of the thrust plate 50 around the central through hole 502. i.e., the thrust surface T, is in surface contact with the end surface P of the orbiting scroll 24.

Figure 3:
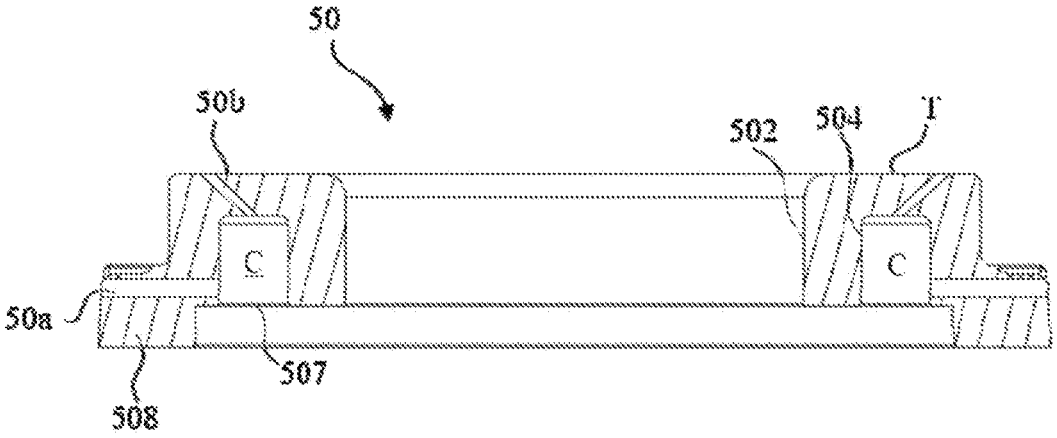
FIG. 3 is a longitudinal cross-sectional view of the thrust plate according to the first embodiment of the present disclosure.

Referring to FIG. 1 and FIG. 2, an oil supply path in communication with the thrust surface T from a side surface is provided inside the thrust plate 50 according to the present disclosure. FIG. 3 is a longitudinal cross-sectional view of the thrust plate according to the present disclosure. As shown in FIG. 3, the thrust plate 50 includes an oil inlet hole 50*a*, an oil groove 504 and an oil outlet hole 50*b*, wherein the oil groove 504 is formed on a side opposite to the thrust surface T, the oil inlet hole 50*a* is in communication with the oil groove 504 through an outer side wall of the thrust plate 50, and the oil outlet hole 50*b* is in communication with the thrust surface T through a top wall of the thrust plate 50 from a top of the oil groove 504. In use, as shown in FIG. 1 and FIG. 2, the thrust plate 50 is mounted between the orbiting scroll 24 and the main bearing housing 40, and an opening of the oil groove 504 is closed by a surface of an element that is in close fit with the bottom of the thrust plate 50 to form a closed oil chamber C, and the oil inlet hole 50*a* is in communication with a pumping mechanism 18 in the oil sump 16 at the bottom of the compressor via an oil pipe L, so that the oil is directly and actively supplied by the pumping mechanism 18. In this way, the pumping mechanism 18 and the oil pipe L can continuously supply lubricating oil to the oil inlet hole 50*a* of the thrust plate 50 during the operation of the compressor, and the lubricating oil entering the thrust plate 50 can be accumulated in the closed oil chamber C. In addition, due to the pressure difference between the oil inlet hole 50*a* and the oil outlet hole 50*b*, the lubricating oil can further flow upward to the thrust surface T, thus provide effective lubrication for the end surface P of the orbiting scroll and the thrust surface T of the of the thrust plate 50. In addition, since the lubricating oil entering the oil chamber C through the oil inlet hole 50*a* flows out through the oil outlet hole 50*b* in such a cycle, the lubricating oil in the oil chamber C is always in a stable flow state. Therefore, the heat generated by the friction between the orbiting scroll end plate 244 and the thrust plate 50 can be taken away more efficiently by the fast lubricating oil flow speed and high oil flow rate while a stable lubrication is provided, which brings an additional cooling effect to the orbiting scroll 24 and the thrust plate 50.

Figure 4:
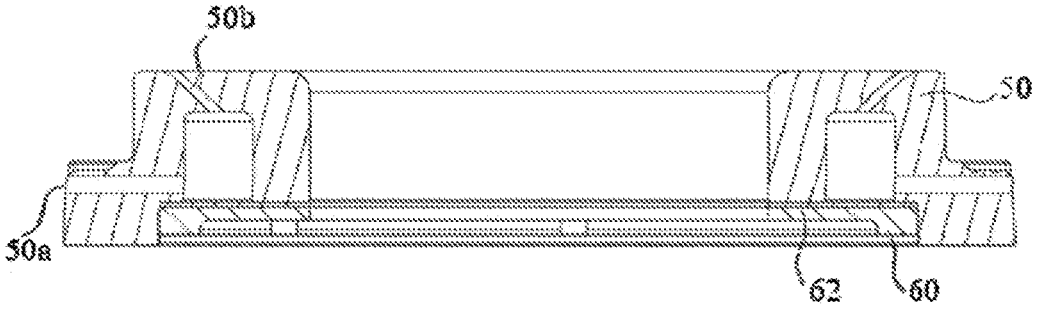
FIG. 4 is a longitudinal cross-sectional view of the thrust plate and a cover plate in an assembled state according to the first embodiment of the present disclosure.

In particular, as a preferred embodiment of the present disclosure, the thrust plate includes at least one oil outlet hole. Preferably, the number of the oil outlet holes 50*b* is greater than the number of the oil inlet holes. More preferably, the number of the oil outlet holes is multiple times of (herein, "multiple times" means more than 2 times, for example, 3, 4, 5 . . . times, etc.) the number of the oil inlet holes, so that a shower-type oil supply path is formed in the thrust plate. For example, the thrust plate may include at least one oil inlet hole. Alternatively, as shown in FIG. 3 and FIG. 4, two oil inlet holes radially symmetrical about a central axis of the thrust plate may be provided, and six oil outlet holes arranged equally spaced apart around the central axis of the thrust plate may be included. By setting the number of the oil outlet holes multiple times of (for example, each oil inlet hole corresponds to or is in communication with three oil outlet holes) the number of the oil inlet holes, the lubricating oil can reach all parts of the thrust surface more uniformly after overflowing from the oil outlet holes without non-uniform distribution of an oil film or local hysteresis by providing multiple uniformly distributed oil outlet holes in a case that only a small number of oil inlet holes are provided, which can provide lubrication and cooling for a contact surface between the orbiting scroll end plate and the thrust plate by using the lubricating oil more effectively, more uniformly and more fully.

Figure 5:
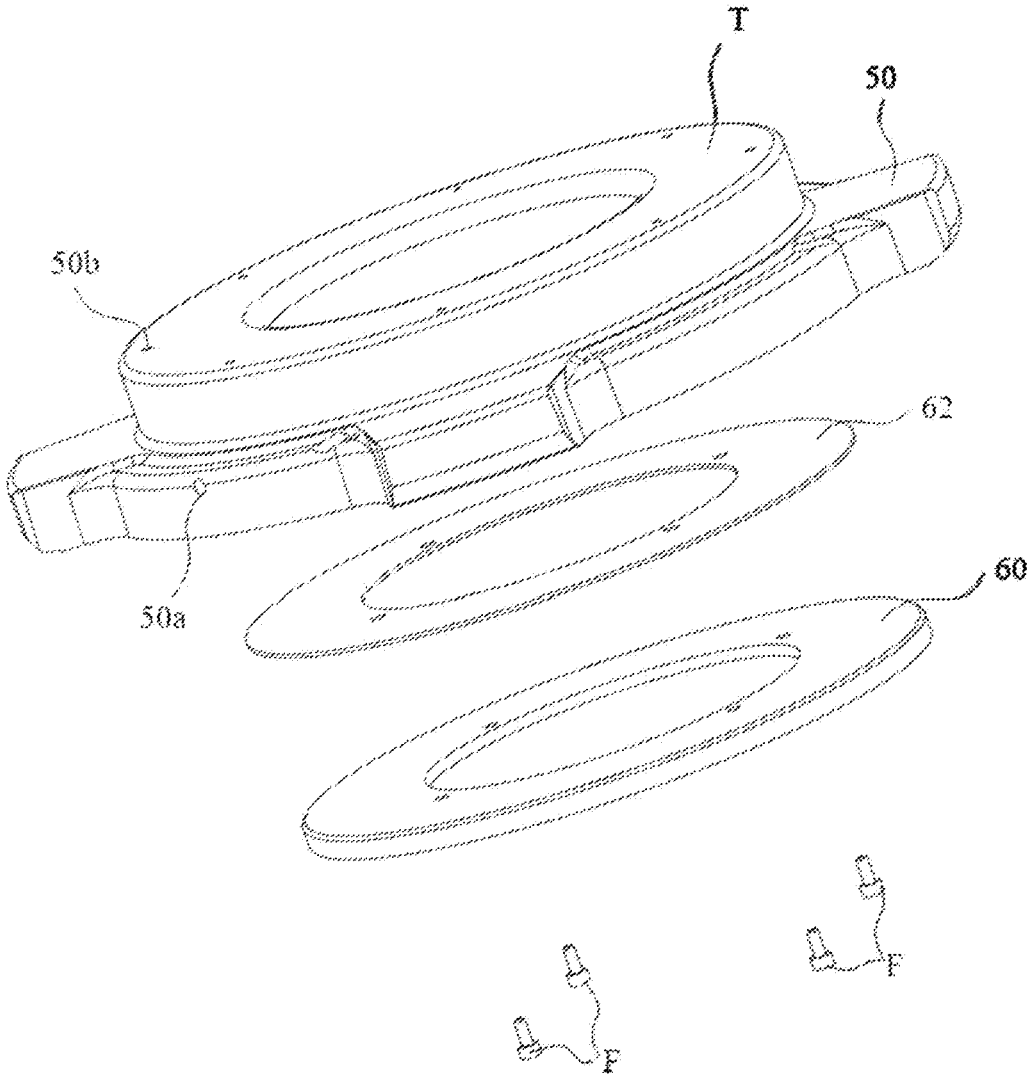
FIG. 5 is an exploded perspective view of the thrust plate and the cover plate according to the first embodiment of the present disclosure.

According to the embodiment of the present disclosure, as shown in FIG. 4 and FIG. 5, the main bearing housing assembly further includes a cover plate 60 located at the bottom of the thrust plate 50 and configured to be in close fit with (including but not limited to an interference fit) a bottom flange 508 of the thrust plate 50, and a gasket 62 for strengthening the sealing effect provided between the cover plate and the thrust plate 50. An upper surface of the gasket 62 abuts against the opening of the oil groove 504 and closes the opening of the oil groove 504, so that the oil groove 504 becomes the closed oil chamber C. The thrust plate 50, the gasket 62 and the cover plate 60 are arranged in a listed sequence from top to bottom and are fixed together with fasteners F such as screws. In the scroll compressor, the thrust plate 50, the gasket 62 and the cover plate 60 may be mounted above the main bearing housing 40 as a whole, to support the orbiting scroll end plate 244.

However, it can be understood by those skilled in the art that the above embodiments are merely examples. In practice, various adaptations can be made.

Herein, the number of the oil inlet holes and the oil outlet holes forming the shower-type oil supply path of the thrust plate is not fixed, and the number of the oil inlet holes and the oil outlet holes can be changed according to the actual situation. In particular, the number and positions of the oil outlet holes can be determined according to specific requirements, such as failure conditions, wear locations, and locations for intentionally enhanced lubrication or cooling. For example, the oil outlet hole may be arranged near a radial outer side (for example, exemplarily shown in FIG. 3) of the thrust surface T in a case where the wear near the radial outer side of the thrust surface T is relatively serious, so as to enhance the lubrication and cooling of a surface of the thrust surface T near the radial outer side; similarly, the oil outlet hole may be arranged near a radial inner side of the thrust surface T in a case where the friction near the radial inner side of the thrust surface T is relatively serious; if necessary, the oil outlet hole may be arranged near the radial outer side and the radial inner side of the thrust surface T simultaneously. In addition, although the oil outlet hole is arranged inclined radially outward from a top of the oil chamber C to the thrust surface T, the orientation of the oil outlet hole can be optional as needed, for example, it can be vertically upward, inclined radially inward, or inclined along a circumferential direction.

In the above embodiments, the thrust plate 50 is shown to include the oil groove 504. The flow rate or circulation efficiency of the lubricating oil in the thrust plate 50 can be increased by providing the oil groove 504, which is beneficial to enhancing the lubrication and cooling effect for the thrust surface T and the end surface P of the orbiting scroll. Herein, the form of the oil groove 504 is not fixed. For example, the oil groove 504 may be an annular groove extending along an entire circumferential direction of the thrust plate 50, and an advantage of this structure is that the lubricating oil has a strong fluidity in the thrust plate 50 so that the lubrication and cooling effect are good. Alternatively, the oil groove 504 may be multiple discrete oil chambers arranged along the entire circumferential direction of the thrust plate 50, and each groove is in communication with at least one oil inlet hole 50*a* and multiple oil outlet holes 50*b*, and an advantage of this structure is that the rigidity of the thrust plate 50 can be better ensured while the lubrication and cooling effect for the thrust surface T and the end surface P of the orbiting scroll are improved. In addition, a longitudinal cross-sectional of the oil groove 504 is optional, which does not need to be rectangular as shown in FIG. 3, but can be any optional shape such as semicircle, trapezoidal, and the like.

Although the thrust plate according to the embodiments of the present disclosure includes the oil groove 504, it can be understood by those skilled in the art that the oil groove is preferred but not necessary. For example, it is conceivable that each oil inlet hole 50*a* can be in communication with multiple oil outlet holes 50*b* to form a shower-type oil supply path, which can also obtain a more uniform and effective lubrication and cooling between the thrust surface T and the end surface P of the orbiting scroll compared with the conventional technology.

Figure 6:
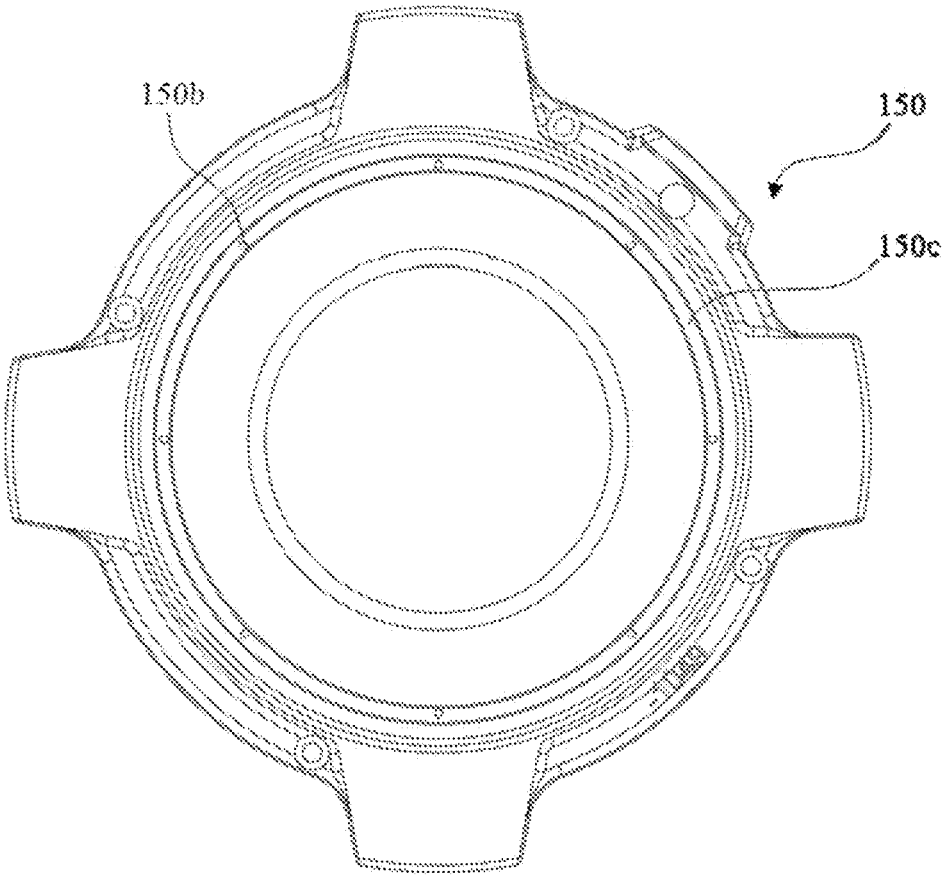
FIG. 6 is a plan view of the thrust plate according to a second embodiment of the present disclosure.
Figure 7:
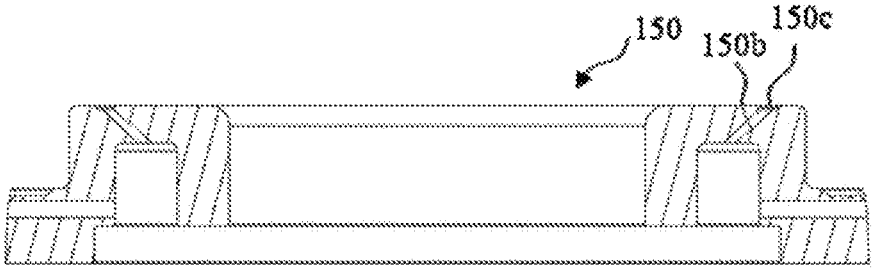
FIG. 7 is a longitudinal cross-sectional view of the thrust plate according to the second embodiment of the present disclosure.

Different from the first embodiment shown in FIGS. 2 to 5 (especially FIG. 5) without an annular groove, FIG. 6 and FIG. 7 show a thrust plate 150 with an improved form according to the present disclosure (that is, the thrust plate 150 according to a second embodiment of the present disclosure). As shown in FIG. 6 and FIG. 7, an annular groove 150*c* extending along the circumferential direction of the thrust surface T is defined on the thrust surface T, and the oil outlet holes 150*b* are connected in series through the annular groove 150*c*, so that the lubricating oil flowing out to the thrust surface T via the shower-type distribution path of the thrust plate 150 can be stored and circulated in the annular groove 150*c*. The lubrication between the thrust surface T and the end surface P of the orbiting scroll can be further enhanced, and the frictional heat can be taken away to a greater extend by promoting the flow of the lubricating oil on the thrust surface T. Preferably, the annular groove 150*c* has a small depth. In addition, it is conceivable that in a case that the orifice of the oil outlet holes 150*b* on the thrust plate 150 are arranged in different radial positions, the annular groove 150*c* may be other shapes that can connect all the orifice in series, or may be arranged as two or more concentric rings according to the positions of the orifices.

Although not shown, the sealing gasket between the thrust plate and the cover plate does not necessarily exist, and a top surface of the cover plate can be used to seal the opening of the oil groove of the thrust plate to form a closed oil chamber. Furthermore, as an alternative, instead of providing a cover plate, the thrust plate can be directly mounted at the top of the main bearing housing, and the opening of the oil groove of the thrust plate can be sealed to form a closed oil chamber through the close fit (such as an interference fit) of the bottom of the thrust plate and the top of the main bearing housing. As another alternative, the thrust plate can be integrally formed on the main bearing housing, that is, the oil chamber is a chamber directly formed inside the main bearing housing, which has a better sealing effect.

Figure 8:
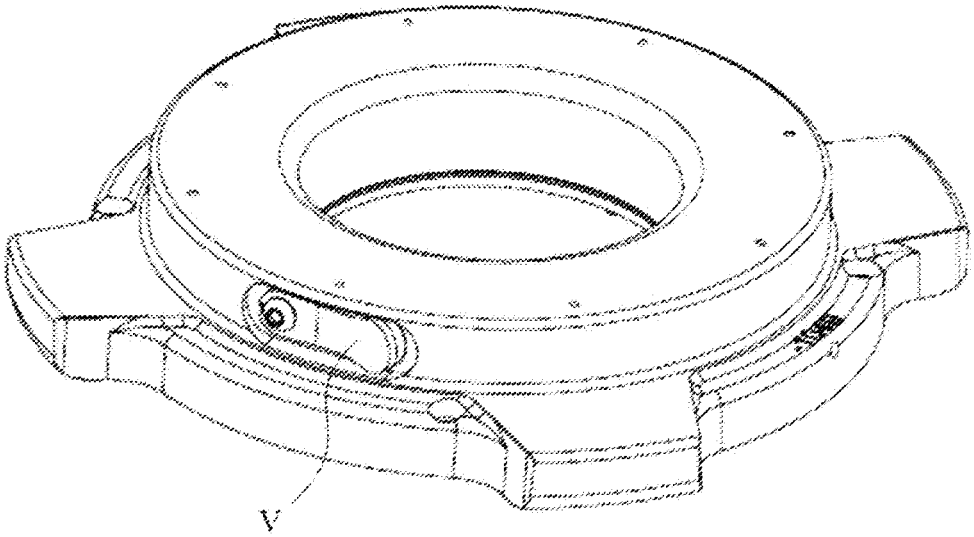
FIG. 8 is a plan view of the thrust plate with a pressure relief valve according to the present disclosure.

According to a preferred embodiment of the present disclosure, the pumping mechanism is a positive displacement pump. Alternatively or additionally, a pressure relief valve V (as shown in FIG. 8) in communication with the oil chamber is provided on a side wall of the thrust plate. In this way, a part of the lubricating oil can be discharged through the positive displacement pump and/or the pressure relief valve V in a case that the pressure in the oil chamber of the thrust plate reaches a certain altitude, so as to avoid failures such as oil pipe rupture and oil pump damage.

However, it should be understood by those skilled in the art that supplying the lubricating oil directly and actively by the pumping mechanism in the oil sump at the bottom of the compressor is merely an exemplary form. The oil inlet hole of the thrust plate may be supplied with the lubricating oil in any other feasible way.

Although the exemplary embodiments of the scroll compressor according to the present disclosure are described in the above embodiments, the present disclosure is not limited thereto, but various modifications, replacements and combinations can be performed without departing from the spirit and protection scope of the present disclosure. These variations and modifications shall still fall in the protection scope of the present disclosure.

The invention claimed is:

1. A main bearing housing assembly for a scroll compressor, comprising:

a main bearing housing, and a thrust plate provided on a top of the main bearing housing and including a thrust surface at a top of the thrust plate and in surface contact with a bottom end surface of a scroll assembly of the scroll compressor, wherein the thrust plate comprises:

at least one oil inlet hole;

a closed oil chamber formed in the thrust plate; and at least one oil outlet hole with an orifice exposed on the thrust surface, wherein the at least one oil inlet hole is in communication with the at least one oil outlet hole through the closed oil chamber.

2. The main bearing housing assembly according to claim 1, wherein:

the closed oil chamber is a single annular oil chamber formed along a circumferential direction of the thrust plate; or the closed oil chamber is a plurality of discrete oil chambers arranged along a circumferential direction of the thrust plate.

3. The main bearing housing assembly according to claim 1, wherein the oil outlet hole is embodied as a plurality of oil outlet holes, and a groove which makes the orifices of the plurality of oil outlet holes to be communicated, is formed on the thrust surface.

4. The main bearing housing assembly according to claim 1, wherein the main bearing housing assembly further comprises a pressure relief valve arranged at the thrust plate for regulating a pressure in the closed oil chamber.

5. The main bearing housing assembly according to claim 1, wherein the oil inlet hole is embodied as a plurality of oil inlet holes which are arranged equally spaced apart around a central axis of the thrust plate.

6. The main bearing housing assembly according to claim 1, wherein the number of the oil outlet hole is greater than the number of the oil inlet hole, and the oil outlet holes are arranged equally spaced apart around a central axis of the thrust plate.

7. The main bearing housing assembly according to wherein:

the thrust plate is integrally formed on the main bearing housing; or the thrust plate is an independent member arranged at the top of the main bearing housing, wherein the thrust plate has an oil groove configured to be closed from a bottom of the oil groove to form the closed oil chamber.

8. The main bearing housing assembly according to claim 7, wherein the oil groove of the thrust plate is sealed by a top surface of the main bearing housing to form the closed oil chamber in a case that the thrust plate is the independent member.

9. The main bearing housing assembly according to claim 7, wherein in a case that the thrust plate is the independent member, the main bearing housing assembly further comprises a cover plate configured to be in close fit with a bottom of the thrust plate, and when the thrust plate and the cover plate are in an assembled state the oil groove of the thrust plate is closed by the cover plate to form the closed oil chamber.

10. A scroll compressor, comprising:

a scroll assembly comprising a non-orbiting scroll member and an orbiting scroll member for compressing a working fluid, and the main bearing housing assembly according to claim.

11. The scroll compressor according to claim 10, wherein the scroll compressor further comprises a pumping mechanism, the pumping mechanism is configured to provide lubricant to a moving part, including the scroll assembly, of the scroll compressor, and the oil inlet hole of the thrust plate is in communication with the pumping mechanism so that the lubricant is directly and actively provided to the thrust plate by the pumping mechanism.

12. The scroll compressor according to claim 11, wherein the pumping mechanism is a positive displacement pump.

* * * * *